US006942553B1

(12) United States Patent
Salafia

(10) Patent No.: US 6,942,553 B1
(45) Date of Patent: Sep. 13, 2005

(54) PORTABLE AUTOMATED SHARPENING APPARATUS FOR AN OPERATIONAL REEL BLADE MECHANISM

(76) Inventor: Massimiliano Salafia, 11520 Terra Bella Blvd., Plantation, FL (US) 33325

( * ) Notice: Subject to any disclaimer, the term of this patent is extended or adjusted under 35 U.S.C. 154(b) by 0 days.

(21) Appl. No.: 10/846,046

(22) Filed: May 14, 2004

(51) Int. Cl.[7] ..... B24B 3/00
(52) U.S. Cl. ..... 451/141; 451/421; 451/128
(58) Field of Search ..... 451/128, 141, 451/349, 421, 359, 122, 225, 230, 235, 272

(56) References Cited

U.S. PATENT DOCUMENTS

| | | | | |
|---|---|---|---|---|
| 2,193,854 | A | | 3/1940 | Benedict |
| 2,554,676 | A | | 5/1951 | Masterson |
| 2,586,236 | A | | 2/1952 | Lewis et al. |
| 2,613,483 | A | | 10/1952 | Lewis et al. |
| 3,019,568 | A | | 2/1962 | Sauers et al. |
| 3,059,383 | A | | 10/1962 | Walin et al. |
| 3,677,316 | A | | 7/1972 | Markham |
| 3,724,139 | A | | 4/1973 | Leverenz |
| 3,800,480 | A | | 4/1974 | Keating |
| 3,863,403 | A | | 2/1975 | Fleming |
| 3,996,818 | A | | 12/1976 | Lindsay |
| 4,148,158 | A | | 4/1979 | Hewitt |
| 4,321,773 | A | | 3/1982 | Fleming |
| 4,694,613 | A | * | 9/1987 | Bernhard ..... 451/150 |
| 4,746,330 | A | | 5/1988 | Johnson |
| 5,172,521 | A | | 12/1992 | McClure et al. |
| 5,321,912 | A | * | 6/1994 | Neary et al. ..... 451/141 |
| 5,371,977 | A | | 12/1994 | Liner |
| 5,725,415 | A | * | 3/1998 | Bernhard ..... 451/45 |
| 6,685,544 | B1 | * | 2/2004 | Dieck et al. ..... 451/141 |
| 6,758,730 | B1 | * | 7/2004 | Bernhard ..... 451/349 |

* cited by examiner

*Primary Examiner*—Dung Van Nguyen
(74) *Attorney, Agent, or Firm*—Malloy & Malloy, P.A.

(57) ABSTRACT

A portable automated sharpening apparatus is structured to sharpen one or more of a plurality of blades of an operational reel blade mechanism, the apparatus including a sharpening assembly with a sharpening element movably interconnected to a sharpening motor. The apparatus also includes a drive assembly having a drive member which at least partially defines a drive path, the drive member further structured to transport the sharpening assembly along at least a portion of the drive path. A support assembly is structured to removably yet securely interconnect at least the drive assembly to the operational reel blade mechanism, and a guide assembly maintains a sharpening axis of the sharpening assembly substantially parallel to a reel blade axis. Further, the apparatus includes a control assembly to allow automatic alternation of a direction of transport of the sharpening assembly, in a reciprocating manner.

23 Claims, 4 Drawing Sheets

PORTABLE AUTOMATED SHARPENING APPARATUS FOR AN OPERATIONAL REEL BLADE MECHANISM

BACKGROUND OF THE INVENTION

1. Field of the Invention

The present invention is directed to a portable automated sharpening apparatus structured to sharpen a plurality of blades of a reel blade mechanism. Specifically, the present invention is structured to be mounted onto an "operational reel blade mechanism" to sharpen the blades thereof, the operational reel blade mechanism being at least partially, yet operably, interconnected to a propelling device such as a tractor, a driving mower, or other such propulsion device.

2. Description of the Related Art

Among the various types of lawn maintenance equipment utilized to cut grass and/or other vegetation are a number of lawn mowing devices which include one or more reel blade mechanisms. Lawn mowing devices employing such reel blade mechanisms are generally utilized for larger commercial, industrial and/or institutional applications, wherein a single propelling device, such as a mower or a tractor may include a plurality of reel blade mechanisms, however, heavy duty hand operated residential lawn mowing devices may also include one or more reel blade mechanism. Reel blade mechanisms typically include one or more blades attached to a reel, wherein these reel blades are structured to rotate about a reel blade axis. In addition, these reel blade mechanisms generally include a reel blade drive structured to rotate the reel blade mechanism and, more specifically, the associated reel blades, about a reel blade axis. The reel blade drives are normally powered by a hydraulic, pneumatic, or other power supply system of the propelling device, once again, such as a mower or a tractor.

In light of the heavy duty usage of such reel blade mechanisms, it should be apparent that routine maintenance necessarily includes periodic sharpening of each of the plurality of blades of the reel blade mechanisms. Often times, the reel blade mechanism will include one or more fixed blades, such as a bed knife, in addition to the rotating reel blades. Thus, as should also be apparent, the process of sharpening each of the plurality of blades of a reel blade mechanism can be a complex and time consuming task. To begin, most sharpening devices require the complete removal of each reel blade mechanism from its propelling device, be it a mower or a tractor, after which the reel blade mechanism is hoisted onto and interconnected to a sharpening device. In at least one known sharpening device, this process includes the interconnection of the reel blade mechanism to an auxiliary hydraulic, pneumatic, or other powered drive system, such that the reel blades of the mechanism may be rotated to effect sharpening via a procedure known as spin-grinding. Some sharpening devices provide a means to drive a sharpening head across the blades of the reel assembly, such as is required during a spin-grinding procedure, however, a significant number of known devices rely upon an operator to manually "drive" a sharpening head across the reel blades, which often results in uneven sharpening of the blade or blades.

In addition to the aforementioned sharpening devices, a number of portable sharpening devices are also known. While such devices may eliminate the need for the complete removal of the reel blade mechanism from its propelling device, these sharpening devices typically only sharpen one blade at a time, and thus, they can not be utilized for the precision spin-grinding procedure noted above, and as discussed further below. In addition, the known portable sharpening devices normally require the operator to manually "drive" the sharpening head across the reel blades which, once again, often results in uneven sharpening of the blades.

As such, it would be beneficial to provide an apparatus which is both portable and automated to effect the sharpening of a plurality of blades of a reel blade mechanism in a precise and efficient manner. Specifically, it would be desirable to provide an apparatus which may be removably yet securely interconnected to a reel blade mechanism while the reel blade mechanism remains in an operational relationship with its propelling device. More in particular, it would be beneficial to eliminate the time and expense of completely disconnecting the reel blade mechanism from its propelling device, at least as far as the disconnection of a reel blade drive from the pneumatic, hydraulic, or other power supply system of the propelling device, interconnection of the reel blade mechanism to an auxiliary pneumatic, hydraulic, or other powered drive system to operate the reel blade mechanism during a spin-grinding procedure, and reconnection of the reel blade drive to the pneumatic, hydraulic, or other power supply system of the propelling device. Additionally, it would be beneficial to eliminate the expense of such an auxiliary pneumatic, hydraulic, or other powered drive system to operate the reel blade mechanism during a spin-grinding procedure. Also, it would be preferable to provide an apparatus which automatically transports a sharpening element disposed in an operative orientation with a reel blade mechanism in a reciprocating manner during a spin-grinding procedure, so as to effect even and precise sharpening of each of a plurality of reel blades of the reel blade mechanism. It would also be helpful for such an apparatus to be adaptable to effect sharpening of one or more fixed blades of a reel blade mechanism, such as a knife blade.

SUMMARY OF THE INVENTION

As indicated above, the present invention is directed to a portable automated sharpening apparatus being structured to sharpen at least one, but preferably, a plurality of blades of a reel blade mechanism. More specifically, the present apparatus is structured to sharpen one or more blades of an operational reel blade mechanism, the operational reel blade mechanism being discussed more fully below. The apparatus includes a sharpening assembly having at least one sharpening element, the sharpening element being movable about a sharpening axis. The sharpening assembly is structured such that the sharpening element is disposable in an operative orientation with the operational reel blade mechanism.

Another aspect of the sharpening apparatus of the present invention is a drive assembly which comprises a drive member, wherein the drive member at least partially defines a drive path. The drive assembly also includes a drive motor which engages the drive member in a driving relation. More in particular, the drive member is structured to transport the sharpening assembly, which is disposed to operatively engage the drive member, along a portion of the drive path. At least one embodiment of the present invention comprises a guide assembly structured and disposed to maintain the sharpening axis of the sharpening assembly in an operative alignment with a reel blade axis.

The portable automated sharpening assembly of the present invention also includes a support assembly structured to removably interconnect at least the drive assembly to the operational reel blade mechanism such that the sharpening element is disposed in an operative orientation with the operational reel blade mechanism. In addition, the apparatus of the present invention comprises a control assembly structured to automatically alternate a direction of transport of the sharpening assembly along the drive path in a reciprocating manner.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
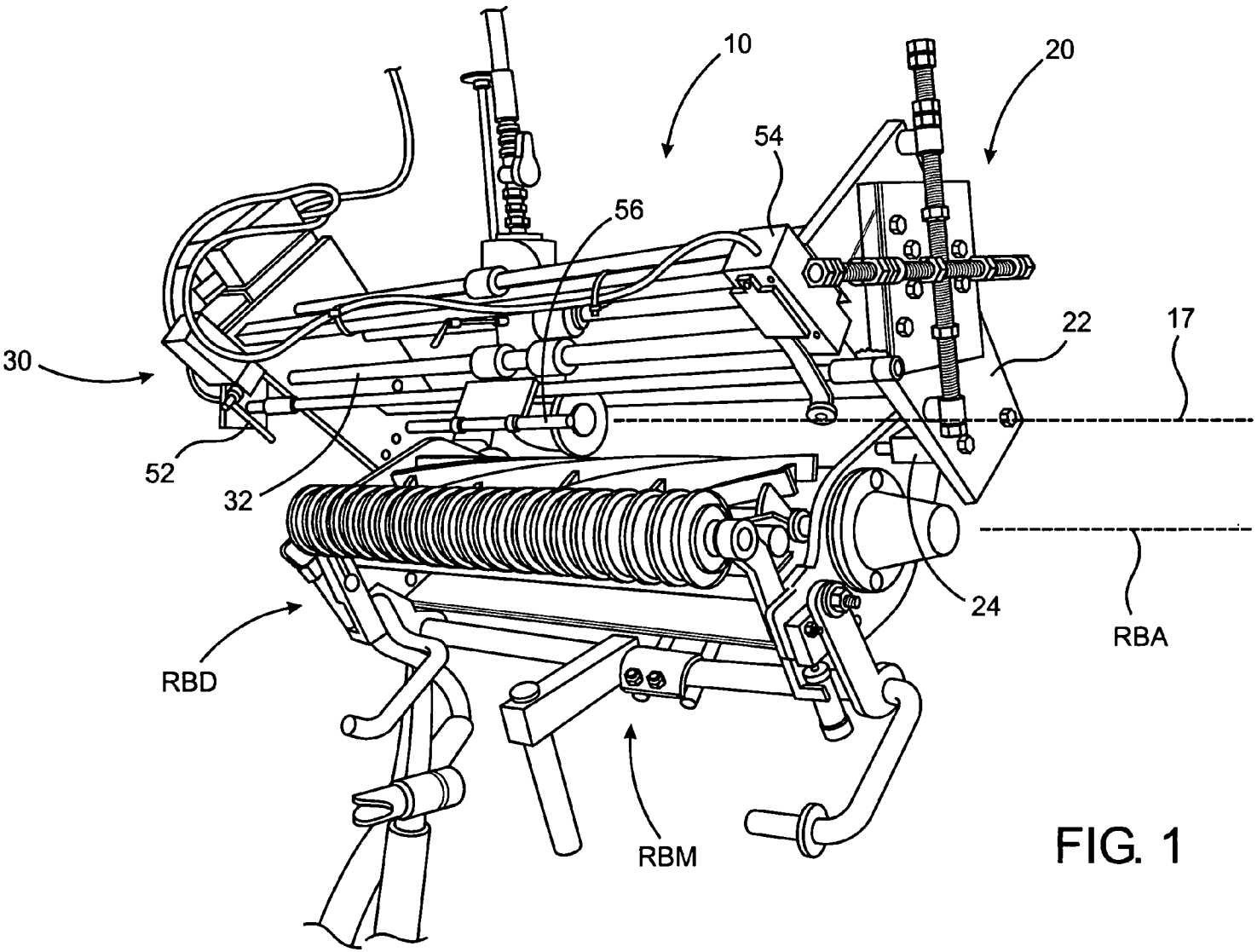
FIG. 1 a perspective view of one preferred embodiment of a portable automated sharpening apparatus of the present invention interconnected to an operational reel blade assembly.
Figure 2:
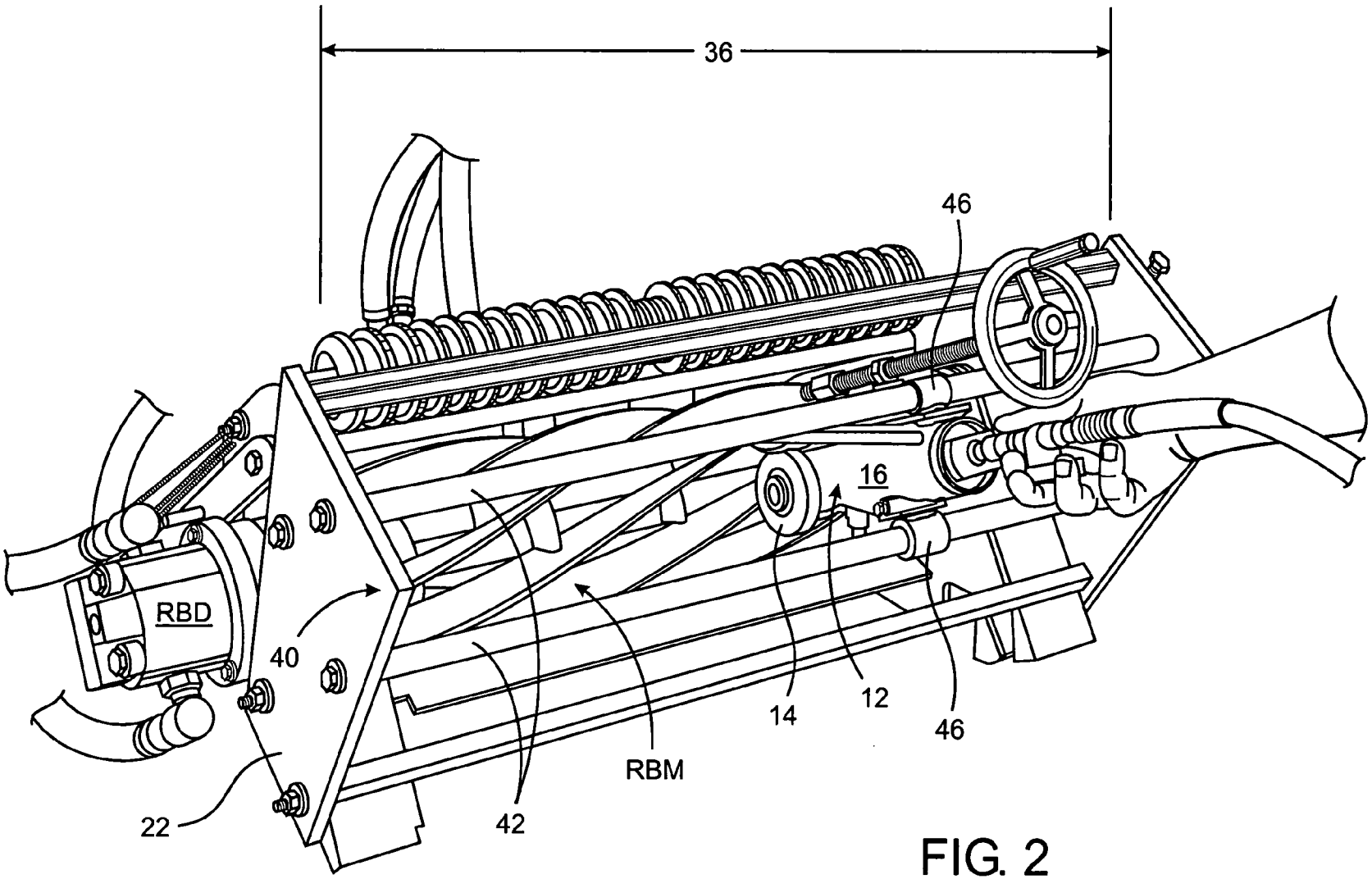
FIG. 2 a perspective view of another embodiment of a portable automated sharpening apparatus of the present invention interconnected to an operational reel blade assembly.

The present invention is directed to a portable automated sharpening apparatus, generally as shown at 10 throughout the figures, structured to sharpen one or more of a plurality of blades of a reel blade mechanism, indicated as "RBM" in FIGS. 1 and 2. More in particular, the portable automated sharpening apparatus 10 of the present invention is specifically structured for utilization with an "operational reel blade mechanism" as illustrated, by way of example only, in FIGS. 1 and 2.

An "operational reel blade mechanism" as referenced herein shall be understood to be a reel blade mechanism which remains at least partially, yet operably, interconnected to its propelling device, whether it be a hand operated mower, a driving mower, a tractor, or other such propelling device. Although some components of the reel blade mechanism may be temporarily disconnected or removed to facilitate access to the reel blades for sharpening, for example, one or more rollers and/or a bed knife, the "operational reel blade mechanism" remains operably interconnected to and is "operated" by a reel blade drive, indicated as "RBD" in the figures, just as the reel blade drive "operates" the reel blade mechanism under normal operating conditions, such as while mowing a lawn or cutting other vegetation. Additionally, the "operational reel blade mechanism" referenced herein utilizes a power supply system of the propelling device to "operate" the reel blade mechanism under normal operating conditions, whether it be a hydraulic, pneumatic, or other power supply system, as well as to "operate" the "operational reel blade mechanism" during a sharpening procedure utilizing the present invention.

As is readily apparent, eliminating the need for an auxiliary hydraulic, pneumatic, or other powered drive system, as incorporated into known devices utilized for sharpening reel blade mechanisms, necessarily results in significant cost savings in the manufacture of the sharpening apparatus 10 of the present invention, thus making the sharpening apparatus 10 more readily available for widespread usage. In addition, the elimination of the auxiliary powered drive system allows the sharpening apparatus 10 of the present invention to be portable, such that it may be readily transported to an "operational reel blade mechanism" requiring sharpening, rather than transporting the entire propelling device, including one or more reel blade mechanisms, to one of the known stationary devices utilized for sharpening reel blade mechanisms.

As is also readily apparent, the sharpening apparatus 10 of the present invention also provides significant operational cost savings based on the fact that an operator does not have to disconnect and reconnect the power supply system of the propelling device to and from the reel blade drive, nor does the operator have to connect and disconnect an auxiliary powered drive system to and from the reel blade mechanism, as is required utilizing the known devices for sharpening reel blade mechanisms. Furthermore, by eliminating the steps of connecting and disconnecting the hydraulic or pneumatic systems, utilization of the sharpening apparatus 10 of the present invention also eliminates the costly, and potentially hazardous, release of fluids from such systems as often occurs during the connection and disconnection operation.

With the foregoing understanding of an "operational reel blade mechanism," as referenced herein, we now turn to the specifics of the portable automated sharpening apparatus 10 of the present invention. To begin, the sharpening apparatus 10 includes a sharpening assembly, generally as shown at 12, having at least one sharpening element 14 structured to effect the actual sharpening of each of a plurality of blades of the operational reel blade mechanism. The sharpening element 14 of the present invention may be constructed of one or more of the various abrasive materials utilized to sharpen knives and blades. In at least one embodiment, the sharpening element 14 comprises a cylindrical configuration similar to a grinding wheel, as illustrated in the figures and as are commonly utilized in the known devices for spin-grinding the plurality of blades of a reel blade mechanism.

The sharpening assembly 12 comprises a sharpening motor 16 having the at least one sharpening element 14 interconnected thereto. More in particular, the sharpening element 14 is moveably interconnected to the sharpening motor 16, and in at least one embodiment, the sharpening element 14 is movable about a sharpening axis 17 of the sharpening motor 16, the sharpening axis 17, in at least one embodiment, being at least partially defined by an axis of a drive shaft of the drive motor 16. In one further and preferred embodiment, the sharpening element 14 is structured to rotate about the sharpening axis 17, as indicated by the directional arrows in FIGS. 3 and 4. Specifically, the sharpening element 14 is interconnected to the sharpening motor 16 in such a manner that the sharpening motor 16 rotates the sharpening element 14 about the sharpening axis 17. In at least one embodiment, the sharpening motor 16 is structured to rotate the sharpening element 14 about the sharpening axis 17 in a direction common with a direction of rotation of a plurality of reel blades of the reel blade mechanism about a reel blade axis, indicated as RBA in FIG. 1.

In addition to the sharpening assembly 12, the portable automated sharpening apparatus 10 of the present invention also comprises a drive assembly, generally as shown at 30. The drive assembly 30 comprises a drive member 32, which at least partially defines a drive path 36. The sharpening assembly 12 is structured to operatively engage the drive member 32, via at least one drive member mount 38, in such a manner that the sharpening assembly 12 may be transported along at least a portion of the drive path 36, as discussed more fully below.

Specifically, the drive assembly 30 comprises a drive motor 34 which is structured and disposed to engage the drive member 32 in a driving relation so that the drive member 32 may transport the sharpening assembly 12 along the portion of the drive path 36. As such, in one embodiment, the drive member 32 comprises a belt or a chain which is driven along the drive path 36 by a pulley assembly attached to the drive motor 34. Alternatively, the drive member 32 may comprise a reciprocating rod or shaft structured to be pushed and pulled along a portion of the drive path 36 by the drive motor 34. In one preferred embodiment, and as illustrated in the figures, the drive member 32 comprises a threaded shaft or screw which is rotated by the drive motor 34. The sharpening assembly 12 operatively engages the drive member 32 via drive member mount 38 which, in this preferred embodiment, comprises a thread pattern which compliments and engages the threaded shaft or screw of the drive member 32, such that the drive member mount 38 is propelled along the drive member 32 as the drive member 32 is rotated by the drive motor 32. Of course, it will be understood by those familiar with the art that the direction in which the drive member mount 38 and, thus, the sharpening assembly 12 are propelled along the drive member 32 is dependant upon the direction of rotation of the drive member 32 by the drive motor 34.

The portable automated sharpening apparatus 10 of the present invention also includes a support assembly, generally shown as 20 throughout the figures. The support assembly 20 is structured to removably interconnect one or more components of the sharpening apparatus 10 to an operational reel blade mechanism such that a blade sharpening procedure may be performed. In a preferred embodiment, the support assembly 20 is structured such that at least the drive assembly 30 is removably interconnected to the operational reel blade mechanism, however, the present invention also provides for additional components of the sharpening apparatus 10 to be interconnected to the operational reel blade assembly, as will become apparent in light of the discussion below.

In one embodiment of the present invention, the support assembly 20 includes at least one, but preferably, a plurality of support members 22, which may be removably mounted to the operational reel blade mechanism. As illustrated in the figures, the support members 22 comprise a generally plate like configuration, and the driving assembly 30 engages a portion of each support member 22, however, it is to be understood that alternate configurations of the support member(s) 22 are within the scope and intent of the present invention. The important aspect of the support member(s) 22 is not a specific configuration, rather that the support members 22 be structured such that upon removably interconnecting the drive assembly 30 to the operational reel blade mechanism, with the sharpening assembly 12 operatively engaging the drive assembly 30 as indicated above, the sharpening axis 17 is disposed substantially parallel with a reel blade axis "RMA" along the drive path 36, as illustrated in FIG. 1. This substantially parallel alignment assures that the sharpening element 14 engages each of the plurality of blades of the reel blade mechanism evenly across the length of each blade to assure that the blades are evenly sharpened during the blade sharpening procedure.

The support assembly 20 is further structured to dispose the sharpening element 14 into an operative orientation with the operational reel blade mechanism, upon interconnection thereto, such that the sharpening element 14 is positioned in a sharpening orientation with at least one blade of the operational reel blade mechanism. Of course, in one preferred embodiment, and as illustrated in the figures, the sharpening element 14 is positioned in the sharpening orientation with a plurality of blades of the operational reel blade mechanism. The sharpening orientation is at least partially defined by positioning the sharpening element 14 into contact with one or more blades such that contact imparts a sharpened edge to the blade(s). Furthermore, the sharpening orientation may be defined in relation to a plurality of movable reel blades of the operational reel blade mechanism or, in at least one embodiment, in relation to one or more fixed blades, such as a knife blade.

To facilitate this type of interconnection, the support assembly 20 may comprise a mounting mechanism 24 structured to permit removable yet secure interconnection of one or more support members 22 to the operational reel blade assembly. In at least one embodiment, the mounting mechanism 24 comprises a plurality of fasteners 26, for example, a plurality of nuts and bolts, disposed in a mounting arrangement with each of the support members 22 and the corresponding portions of the operational reel blade mechanism, thereby allowing the support assembly 20 to be removably and securely interconnected to the operational reel blade mechanism. In at least one other embodiment, the mounting mechanism 24 may comprise one or more clamps or other quick-connect devices to facilitate the removable yet secure interconnection of the support assembly 20 to the operational reel blade mechanism.

As indicated above with respect to the support member(s) 22, the specific configuration of the mounting mechanism 24 is secondary, the important aspect being that the support assembly 20 is removably yet securely interconnected to the operational reel blade mechanism such that the sharpening axis 17 is substantially parallel with the reel blade axis along the drive path 36. Further, the secure interconnection of the support assembly 20 is at least partially defined by the support assembly 20 and any other components of the sharpening apparatus 10 interconnected thereto being maintained in position relative to the operational reel blade mechanism during the performance of a sharpening procedure. More specifically, the sharpening procedure necessarily produces frictional and vibrational forces which are, oftentimes, significant forces acting upon the support assembly 20 and, therefore, secure interconnection requires that the sharpening axis 17 remains substantially parallel with the reel blade axis along the drive path 36 throughout the procedure.

Figure 3:
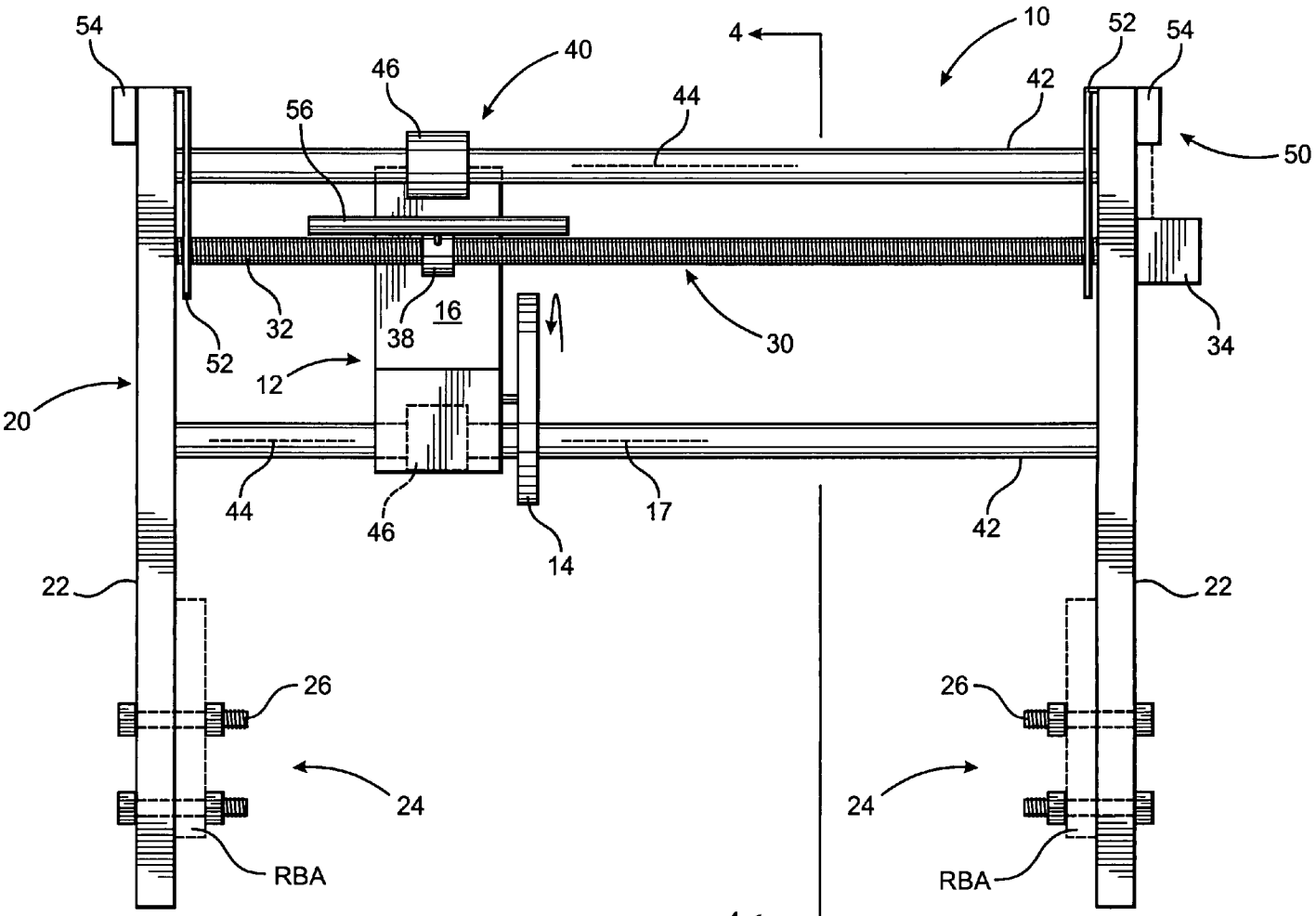
FIG. 3 is a front elevation of one other preferred embodiment of a portable automated sharpening apparatus of the present invention.

At least one embodiment of the portable automated sharpening apparatus 10 of the present invention further comprises a guide assembly, generally as shown at 40. The guide assembly 40 is attached to the support assembly 20, in one preferred embodiment, and is structured to maintain the sharpening axis 17 in an operative alignment, i.e. a substantially parallel alignment, with the reel blade axis during transport of the sharpening assembly 12 along the portion of the drive path 36. As such, the guide assembly 40 includes at least one guide track member 42 having a guide track axis 44, and in a preferred embodiment, the guide assembly 40 comprises a plurality of guide track members 42 each having a guide track axis 44, as illustrated in FIG. 3. The guide assembly 40 further comprises at least one guide member mount 46 structured to movably mount the sharpening assembly 12 to at least one guide track member 42. As illustrated in the preferred embodiment of FIG. 3, the guide assembly 40 comprises a plurality of guide member mounts 46, each structured to movably mount the sharpening assembly 12 to a different one of each of the plurality of guide track members 42, each of the guide member mounts 46 structured to fit snugly over the corresponding guide track member 42 so as to generally maintain alignment of a common axis therewith over the length of the guide track member 42.

As illustrated in the embodiment of FIG. 3, each guide track axis 44 is substantially parallel to the sharpening axis 17, and to one another. As such, it is apparent that each guide track axis 44 will be substantially parallel to the reel blade axis when the sharpening axis 17 is positioned in operative alignment, substantially parallel to the reel blade axis. Therefore, once the sharpening axis 17 is positioned in operative alignment with the reel blade mechanism, the guide assembly 40 will maintain the sharpening assembly 12 and, more specifically, the sharpening axis 17 in this operative alignment, substantially parallel with the reel blade axis, while the sharpening assembly 12 is being transported along the portion of the drive path 36.

The portable automated sharpening apparatus 10 of the present invention further comprises a control assembly, generally as shown at 50 throughout the figures, the control assembly 50 being at least structured to automatically alternate a direction of travel of the sharpening assembly 12 along the drive path 36, in a reciprocating manner. More specifically, the control assembly 50 is at least structured to automatically reverse the direction of travel of the sharpening assembly 12 along the drive path 36 based upon one or more predetermined control limits. In one preferred embodiment, the control assembly 50 is structured to automatically and repeatedly reverse the direction of travel, such that the sharpening assembly 12 automatically cycles back and forth along the drive path 36 for a plurality of cycles as determined by the operator.

The control assembly 50 comprises at least one control limit indicator 52 positionable by the operator along the drive path 36, so as to define at least one predetermined control limit, and thereby at least partially defining a portion of the drive path 36. In a preferred embodiment, the control assembly 50 comprises at least one pair of control limit indicators 52, each positionable along the drive path 36 to define at least a pair of predetermined control limits. In particular, the control limit indicators 52 are structured to define the outermost limits of a path of travel of the sharpening element 14 along the drive path 36, as illustrated in FIG. 3. Typically, the control limit indicators 52 are positioned to coincide with an overall length of the reel blades of the operational reel blade mechanism, thereby assuring that the sharpening element 14 can contact the entire length of the reel blades during a sharpening procedure.

Additionally, the control assembly 50 includes at least one control limit switch 54 disposed in a communicative association with a corresponding control limit indicator 52, as well as with the drive motor 34. Upon actuation, the control limit switch 54 is structured to cause the drive motor 34 to reverse direction, thus reversing the direction of travel of the drive member 32 and the sharpening assembly 12 operatively engaged thereto, along the drive path 36. As will be appreciated by one skilled in the art, there are a variety of switching devices which may be utilized to reverse a driving mechanism, such as the drive motor 34 of the present invention, any of which the control limit switch 52 of the present invention may comprise.

In one preferred embodiment, the control assembly 50 comprises at least one pair of control limit switches 54, each being disposed in a communicative association with a corresponding control limit indicator 52, as well as with the drive motor 34. In this preferred embodiment, each of the control limit switches 52 is structured to cause the drive motor 34 to reverse the direction of travel of the drive member 32, once again, thereby reversing the direction of travel of the sharpening assembly 12, upon actuation.

Figure 4:
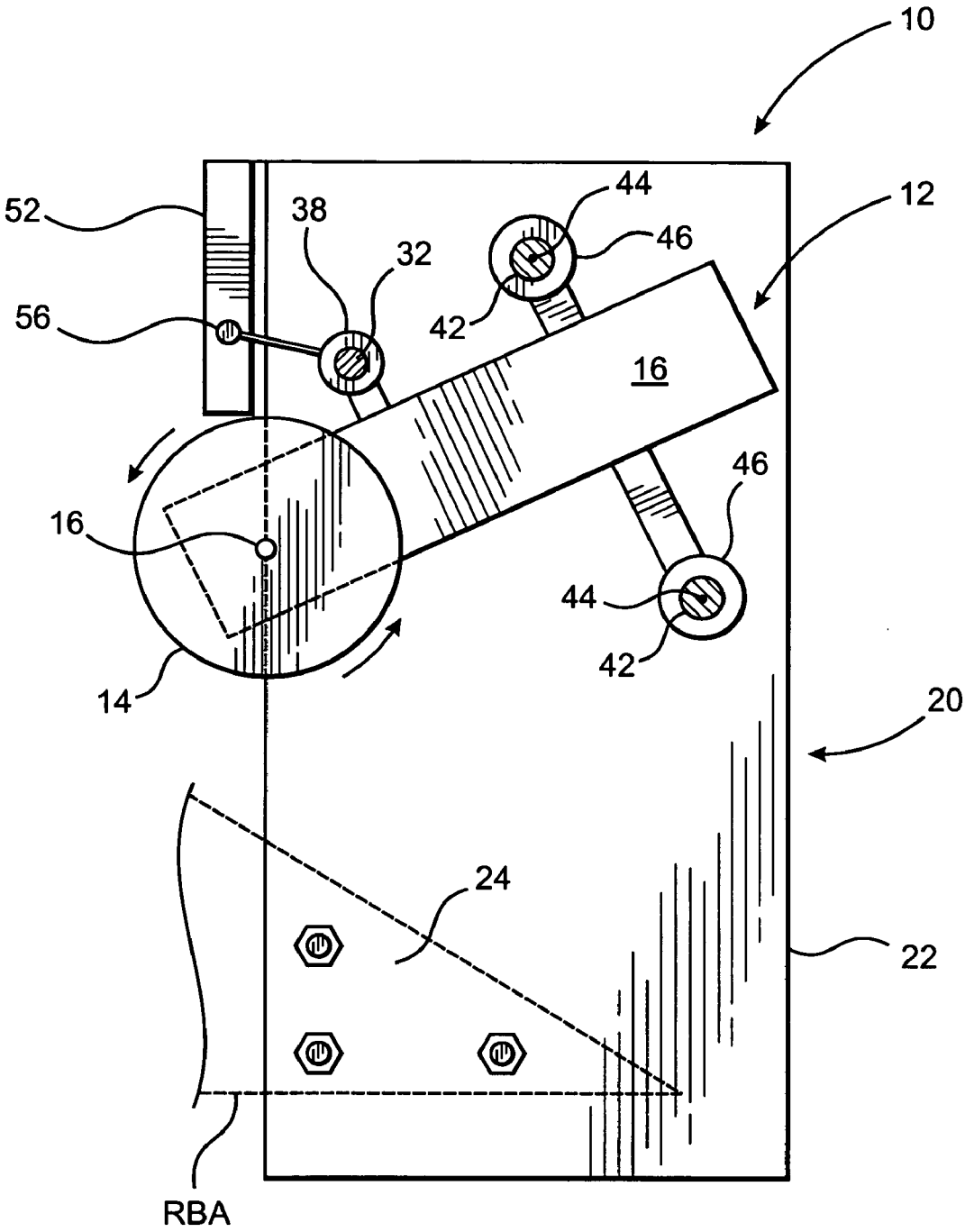
FIG. 4 is a cross-sectional view of the embodiment of FIG. 3 along lines 4—4 thereof.

Further, the control assembly 50 of the portable automated sharpening apparatus 10 of the present invention comprises a control limit actuator 56 structured to actuate one or more control limit switches 52 upon engaging a corresponding control limit indicator 52. As illustrated in the embodiment of FIGS. 3 and 4, the control limit actuator 56 comprises an elongated configuration interconnected to and extending outwardly from either side of the sharpening motor 16, and is disposed generally parallel with the sharpening axis 17 of the sharpening assembly 12. As best illustrated in FIG. 4, the control limit actuator 56 is also disposed in an at least partially aligned relationship with the control limit indicator 52, such that as the sharpening assembly 12 is transported along the drive path 36, the control limit actuator 56 engages the control limit indicator 52 before the sharpening assembly 12 is transported to the control limit of the drive path 36. Further, upon engaging the control limit indicator 52, the control limit actuator 56 actuates a corresponding control limit switch 54, as indicated above, thereby reversing the direction of travel of the sharpening assembly 12 along the drive path 36.

Thus, the control assembly 50 of the present invention may be utilized to repeatedly cycle the sharpening assembly 12 back and forth along the drive path 36 in a reciprocating manner during a sharpening procedure, such as a spin-grinding procedure. Specifically, in one spin-grinding procedure utilizing the portable automated sharpening apparatus 10 of the present invention, the sharpening element 14 is disposed into the sharpening orientation with the plurality of reel blades of the operational reel blade mechanism, and is rotated by the sharpening motor 16 in a direction common with the direction in which the reel blades are rotated about the reel blade axis by the reel blade drive. Further, the sharpening element 14 is maintained in the sharpening orientation with the plurality of reel blades of the operational reel blade mechanism, while the sharpening assembly 12 is transported back and forth along the drive path 36 in a reciprocating manner for the total number of cycles as deemed necessary by the operator.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A portable automated sharpening apparatus structured to sharpen a plurality of blades of an operational reel blade mechanism, said apparatus comprising:

a sharpening assembly including a sharpening motor having at least one sharpening element interconnected thereto, said sharpening motor structured to rotate said sharpening element about a sharpening axis, a drive assembly comprising a drive member, said drive member partially defining a drive path, said sharpening assembly operatively engaging said drive member, said drive assembly further comprising a drive motor engaging said drive member in a driving relation, said drive member structured to transport said sharpening assembly along a portion of said drive path, a support assembly structured to removably interconnect at least said drive assembly to the operational reel blade mechanism such that said sharpening element is disposed in an operative orientation with the operational reel blade mechanism, the operational reel blade mechanism being at least partially, yet operably, interconnected to a propelling device, a control assembly structured to automatically alternate a direction of transport of said sharpening assembly along said portion of said drive path in a reciprocating manner, and a guide assembly structured and disposed to maintain said sharpening axis substantially parallel to a reel blade axis during transport of said sharpening assembly along said portion of said drive path.

2. The apparatus as recited in claim 1 wherein said sharpening motor is further structured to rotate said sharpening element in a common direction with the operational reel blade mechanism.

3. The apparatus as recited in claim 1 wherein said operative orientation is at least partially defined by said sharpening element disposed in a sharpening orientation with at least one blade of the operational reel blade mechanism.

4. A portable automated sharpening apparatus structured to sharpen a plurality of blades of an operational reel blade mechanism, said apparatus comprising:

a sharpening assembly having at least one sharpening element, a drive assembly comprising a drive member, said drive member partially defining a drive path, said sharpening assembly operatively engaging said drive member, said drive assembly further comprising a drive motor engaging said drive member in a driving relation, said drive member structured to transport said sharpening assembly along a portion of said drive path, a control assembly structured to automatically alternate a direction of transport of said sharpening assembly, a guide assembly structured and disposed to maintain a sharpening axis of said sharpening assembly in an operative alignment with a reel blade axis, and a support assembly structured to removably interconnect at least said drive assembly to the operational reel blade mechanism such that said sharpening element is disposed in an operative orientation with the operational reel blade mechanism, the operational reel blade mechanism being at least partially, yet operably, interconnected to a propelling device.

5. The apparatus as recited in claim 4 wherein said sharpening element is movable about said sharpening axis.

6. The apparatus as recited in claim 5 wherein said sharpening element is structured to rotate about said sharpening axis.

7. The apparatus as recited in claim 4 wherein said sharpening assembly further comprises a sharpening motor, said sharpening element movably interconnected thereto.

8. The apparatus as recited in claim 7 wherein said sharpening motor is structured to rotate said sharpening element about said sharpening axis.

9. The apparatus as recited in claim 4 wherein said support assembly comprises at least one support member, said drive assembly and said guide assembly being at least partially interconnected thereto.

10. The apparatus as recited in claim 9 wherein said support member comprises a mounting mechanism structured to facilitate removable yet secure interconnection of at least said drive assembly to the operational reel blade mechanism.

11. The apparatus as recited in claim 10 wherein said mounting mechanism is further structured to position said sharpening axis in an operative alignment with the reel blade axis, said operative alignment at least partially defined by said sharpening axis and the reel blade axis being substantially parallel along said portion of said drive path.

12. The apparatus as recited in claim 11 wherein said sharpening assembly is structured to engage said guide assembly, said guide assembly structured to maintain said sharpening axis substantially parallel to the reel blade axis during transport of said sharpening assembly along said portion of said drive path.

13. The apparatus as recited in claim 4 wherein said operative orientation is at least partially defined by said sharpening element disposed in a sharpening configuration with at least one blade of the operational reel blade mechanism.

14. A portable automated sharpening apparatus structured to sharpen a plurality of blades of an operational reel blade mechanism, said apparatus comprising:

a sharpening assembly including a sharpening motor having at least one sharpening element interconnected thereto, said sharpening motor structured to rotate said sharpening element about a sharpening axis, a drive assembly comprising a drive member, said drive member partially defining a drive path, said sharpening assembly operatively engaging said drive member, said drive assembly comprising a drive motor engaging said drive member in a driving relation, said drive member structured to transport said sharpening assembly along a portion of said drive path, a support assembly structured to removably interconnect at least said drive assembly onto the operational reel blade mechanism such that said sharpening element is disposed in an operative orientation with the operational reel blade mechanism, the operational reel blade mechanism being at least partially, yet operably, interconnected to a propelling device, and a control assembly structured to automatically alternate a direction of transport of said sharpening assembly along said portion of said drive path in a reciprocating manner.

15. The apparatus as recited in claim 14 wherein said control assembly comprises at least one control limit indicator, said control limit indicator at least partially defining said portion of said drive path.

16. The apparatus as recited in claim 15 wherein said control limit indicator is positionable along said drive path.

17. The apparatus as recited in claim 15 wherein said control assembly further comprises at least one control limit switch disposed in a communicative association with a corresponding control limit indicator and said drive motor, said control limit switch structured to cause said drive motor to reverse said direction of transport of said drive member and said sharpening assembly along said drive path upon actuation.

18. The apparatus as recited in claim 17 wherein said control assembly further comprises a control limit switch actuator structured to actuate said control limit switch upon engaging said corresponding control limit indicator.

19. The apparatus as recited in claim 14 wherein said control assembly comprises a pair of control limit indicators, said pair of control limit indicators at least partially defining said portion of said drive path.

20. The apparatus as recited in claim 19 wherein at least one of said pair of control limit indicators is positionable along said drive path.

21. The apparatus as recited in claim 19 wherein said control assembly further comprises at least one control limit switch disposed in a communicative association with a corresponding one of said pair of control limit indicators and said drive motor, said control limit switch structured to cause said drive motor to reverse said direction of transport of said drive member and said sharpening assembly along said drive path upon actuation.

22. The apparatus as recited in claim 19 wherein said control assembly further comprises a pair of control limit switches, each of said control limit switches disposed in a communicative association with a corresponding one of said pair of control limit indicators and said drive motor, each of said pair of control limit switches structured to cause said drive motor to reverse said direction of transport of said drive member and said sharpening assembly along said drive path upon actuation.

23. The apparatus as recited in claim 22 wherein said control assembly further comprises a control limit switch actuator structured to actuate either of said pair of control limit switches upon engagement with said corresponding control limit indicator.

* * * * *